US012656020B2

(12) United States Patent
Reininger et al.

(10) Patent No.: US 12,656,020 B2
(45) Date of Patent: Jun. 16, 2026

(54) METHOD FOR PRODUCING A HEATING DEVICE, AND HEATING DEVICE

(71) Applicant: TRUMA GERÄTETECHNIK GMBH & CO. KG, Putzbrunn (DE)

(72) Inventors: Dennis Reininger, Putzbrunn (DE); Matthias Goller, Putzbrunn (DE)

(73) Assignee: Truma Gerätetechnik GmbH & Co. KG, Putzbrunn (DE)

( * ) Notice: Subject to any disclaimer, the term of this patent is extended or adjusted under 35 U.S.C. 154(b) by 1126 days.

(21) Appl. No.: 17/597,574

(22) PCT Filed: Jul. 10, 2020

(86) PCT No.: PCT/EP2020/000129

§ 371 (c)(1),
(2) Date: Jan. 12, 2022

(87) PCT Pub. No.: WO2021/008719

PCT Pub. Date: Jan. 21, 2021

(65) Prior Publication Data

US 2022/0243957 A1 Aug. 4, 2022

(30) Foreign Application Priority Data

Jul. 17, 2019 (DE) ..... 10 2019 004 952.7

(51) Int. Cl.
*F24H 9/20* (2022.01)
*F24H 6/00* (2022.01)
(Continued)

(52) U.S. Cl.
CPC ..... *F24H 9/2071* (2013.01); *F24H 6/00* (2013.01); *F24H 9/2014* (2013.01); *F24H 15/20* (2022.01); *F24H 15/35* (2022.01); *F24H 9/1863* (2013.01)

(58) Field of Classification Search
CPC ..... F24H 15/20; F24H 15/35; F24H 3/022; F24H 6/00; F24H 9/1863; F24H 9/2014; F24H 9/2071
(Continued)

(56) References Cited

U.S. PATENT DOCUMENTS 7,326,883 B2 * 2/2008 Bertani ..... F24H 3/0411 219/400
2013/0044997 A1 2/2013 French
2019/0216555 A1 * 7/2019 DiMaio ..... A61B 90/50

FOREIGN PATENT DOCUMENTS

AU 561321 B2 5/1987
CA 2174812 A1 11/1996
(Continued)

*Primary Examiner* — Chris Q Liu
*Assistant Examiner* — James F Sims, III
(74) *Attorney, Agent, or Firm* — Murphy, Bilak & Homiller, PLLC

(57) ABSTRACT

The invention relates to a method of manufacturing a heating device (1) which has a fan (3) located behind a grid (2) in an interior (10). The fan (3) is mounted in the interior (10), and the grid (2) is mounted as a part of the heating device (1). The speed of the fan (3) is determined in a contactless manner by evaluating a reflection behavior of the fan (3) in that a light signal (50) is emitted through a recess (20) in the grid (2) in the direction of the fan (3), and/or is received through a recess (20) in the grid (2) from the direction of the fan (3). Furthermore, the invention relates to a heating device (1).

16 Claims, 3 Drawing Sheets

(51) Int. Cl.
*F24H 9/1863* (2022.01)
*F24H 15/20* (2022.01)
*F24H 15/35* (2022.01)

(58) Field of Classification Search
USPC ..... 392/360
See application file for complete search history.

(56) References Cited

FOREIGN PATENT DOCUMENTS

| | | | |
|---|---|---|---|
| DE | 19531660 | A1 | 3/1997 |
| DE | 29607624 | | 8/1997 |
| DE | 19853084 | A1 | 5/2000 |
| GB | 1099275 | | 1/1968 |
| GB | 1528989 | | 10/1978 |

* cited by examiner

METHOD FOR PRODUCING A HEATING DEVICE, AND HEATING DEVICE

FIELD OF THE DISCLOSURE

The invention relates to a method of manufacturing a heating device. Furthermore, the invention relates to a heating device for heating at least one medium. The medium is a liquid (such as water) or air (such as room air), for example.

BACKGROUND

In the prior art, heating devices are known which generate thermal energy by burning propane or butane, which is transferred to air or water as exemplary media via heat exchangers. For the burning process or also for heating the room air, a fan is usually provided which serves to supply the heating device with air. Depending on the design, the air is used for the burning process itself or is the medium to be heated.

When manufacturing such a heating device, it is necessary to determine the speed of the fan. This is carried out, for example, in a contactless manner by evaluating the reflection of light signals, see, for example, DE 198 53 084 A1 for another case of application. For such an optical measurement, it is necessary that the fan is not covered and is thus accessible for the measurement. This is usually counteracted by the fact that a grid is arranged in the front of the fan for protection purposes. This means that usually, the fan is mounted, then the speed is determined, and finally the grid is mounted.

The object on which the invention is based is to propose an effective method of manufacturing a heating device and a correspondingly effectively manufactured heating device.

SUMMARY

According to a first teaching, the object is achieved by the invention by a method of manufacturing a heating device, wherein the heating device has a fan located behind a grid in an interior of the heating device. The method comprises at least the steps of: mounting the fan in the interior of the heating device, mounting the grid as a part of the heating device, and determining the speed of the fan in a contactless manner by evaluating a reflection behavior of the fan, at least one light signal being emitted through a recess in the grid in the direction of the fan, and/or being received through a recess in the grid from the direction of the fan.

The fan and the grid are mounted when manufacturing the heating device. The grid serves as a protection for the fan. In one step, a speed of the fan is determined. The contactless measurement of the speed is performed in that a recess for light signals is present in the grid. The light signals can thus pass in an unhindered manner through the grid for measurement. This in turn makes it possible, for example, to mount the grid before determining the speed. During the measurement of the speed, the fan is active. Preferably, a fan wheel of the fan rotates at a predetermined speed, which represents a set value for the determined speed. Alternatively, a power level can be set for the fan, a set value for the speed being then assigned thereto for processing the measurement data.

One configuration of the method consists in that the determined speed is compared with a set value and a comparison result is generated. In one configuration, a tolerance band for the admissible degree of deviation between the determined speed and the set value of the speed is used for generating the comparison result. In one configuration, a calibration of the fan and/or the heating device is performed on the basis of the comparison result. Alternatively or additionally, an adjustment of the fan is performed on the basis of the comparison result. Alternatively or additionally, the fan is replaced on the basis of the comparison result.

In the aforementioned configurations, the determination of the speed is used to determine whether the fan corresponds to a set value specification as to the speed. In case deviations occur, in one configuration beyond a tolerance band, it is possible to react thereto with the different configurations. Therefore, a calibration can be carried out, i.e. the effective speed is taken into account during operation of the heating device or the fan. Alternatively, the fan is subjected to a post-processing with respect to an adjustment. Again alternatively or additionally, the fan is exchanged and replaced with another fan.

One configuration of the method provides that the fan and the grid are mounted jointly prior to the step of determining the speed. In this configuration, the fan and the grid are present during manufacturing as a finished unit which is mounted.

As an alternative to the previous configuration, the fan and the grid are each mounted separately. However, this is done before the step of determining the speed.

Furthermore, according to a further teaching, the object is achieved by the invention by a heating device for heating at least one medium, wherein the heating device has a fan located behind a grid in an interior of the heating device, and wherein the grid has a recess allowing light to pass through. Preferably, the heating device has been manufactured using the method according to any of the preceding configurations.

One configuration of the heating device consists in that the recess represents a deviation from a grid structure of the grid. In this configuration, the recess thus differs in shape and geometry from the remaining grid structure.

One configuration of the heating device provides that the recess is configured as a circular recess.

One configuration of the heating device consists in that the grid is configured as a grid having a grid structure which includes elongated openings.

One configuration of the heating device provides that the fan has a passage point in a fan wheel and a reflection surface located behind the fan wheel. The light for the measurement of the speed is reflected at the reflection surface. By rotating the fan wheel, the light path from a light source, via the reflection surface and towards a light detector is interrupted. In this configuration, the speed of the fan wheel and thus of the fan can be determined on the basis of the knowledge about the emitted and received light signals.

In an alternative configuration, the fan wheel reflects the light, and a passage point located in the fan wheel causes the reflection to be prevented or at least noticeably reduced. This is done, for example, in that a surface behind the passage point has a strong scattering effect. Alternatively, a change in the propagation time of the light signals is registered and evaluated.

One configuration of the heating device consists in that the heating device heats a plurality of media. In one configuration, the media are in particular water or another water-fluid mixture and air. The heated air is, for example, room air.

In detail, there are a multitude of possibilities for designing and further developing the method according to the invention and the heating device. For this purpose, reference is made, on the one hand, to the claims subordinate to the independent claims, and, on the other hand, to the description below of example embodiments in conjunction with the drawing, in which:

DETAILED DESCRIPTION OF EXAMPLE EMBODIMENTS

Figure 1:
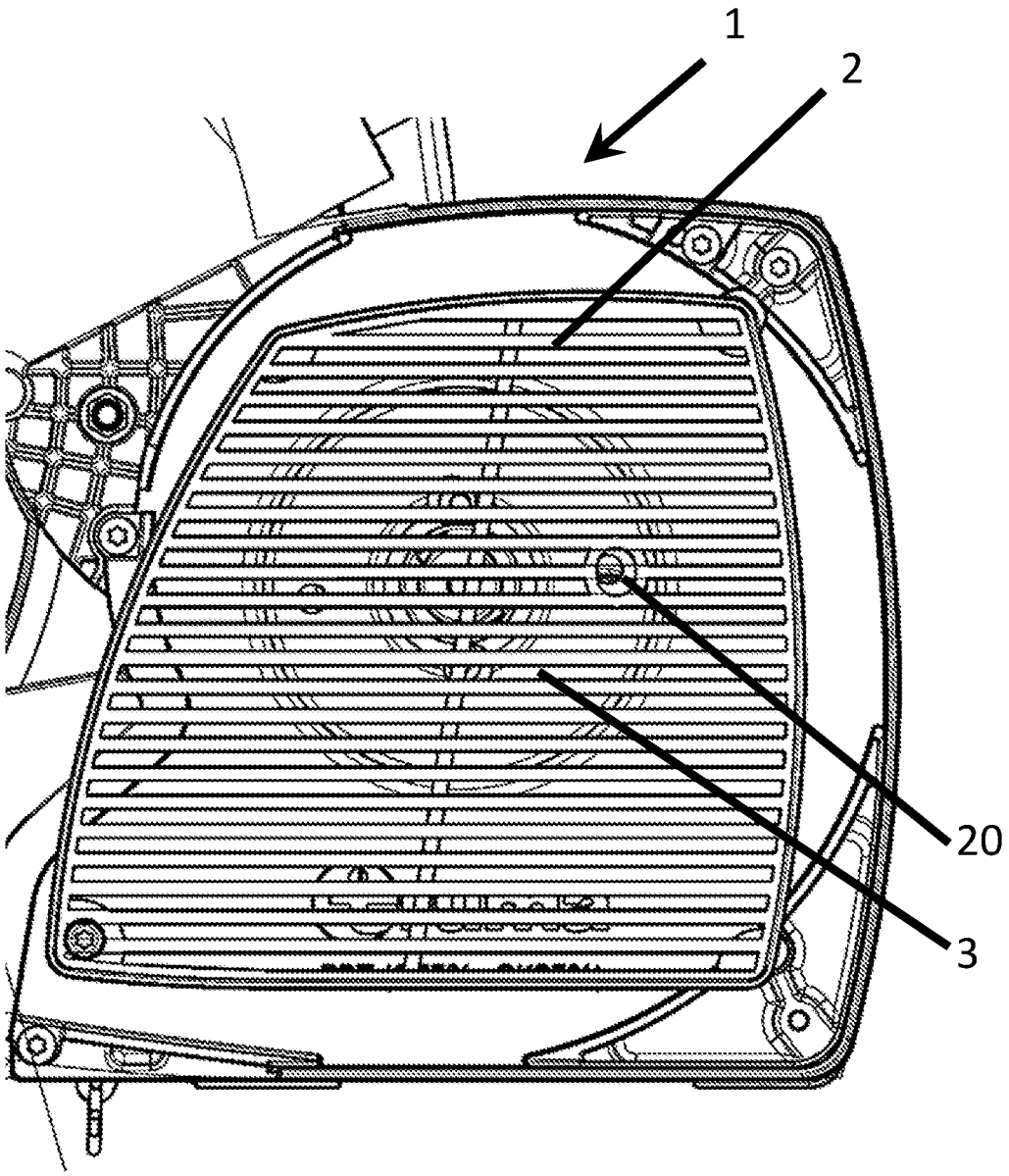
FIG. 1 shows a detail of a top view of a heating device.

FIG. 1 shows a part of a heating device 1 which serves to heat two media. The media are here exemplarily air for heating a room and water. In particular, the area around a fan 3, which transports fresh air into the heating device 1, is shown. The fan 3 is located behind a grid 2, which prevents objects from being pulled into the fan 3 or a person from reaching into the fan 3 during operation. It can be seen that the grid 2 has been attached to the housing of the heating device 1 via a screw on the lower left edge.

The grid 2 generally has a grid structure which is characterized by elongated openings. The recess 20 which is circular in the example embodiment shown is provided in the region of the fan 3. Therefore, the recess 20 is a deviation from the remaining grid structure. It allows the speed of the fan 3 to be determined without contact by evaluating the reflection of light signals.

Figure 2:
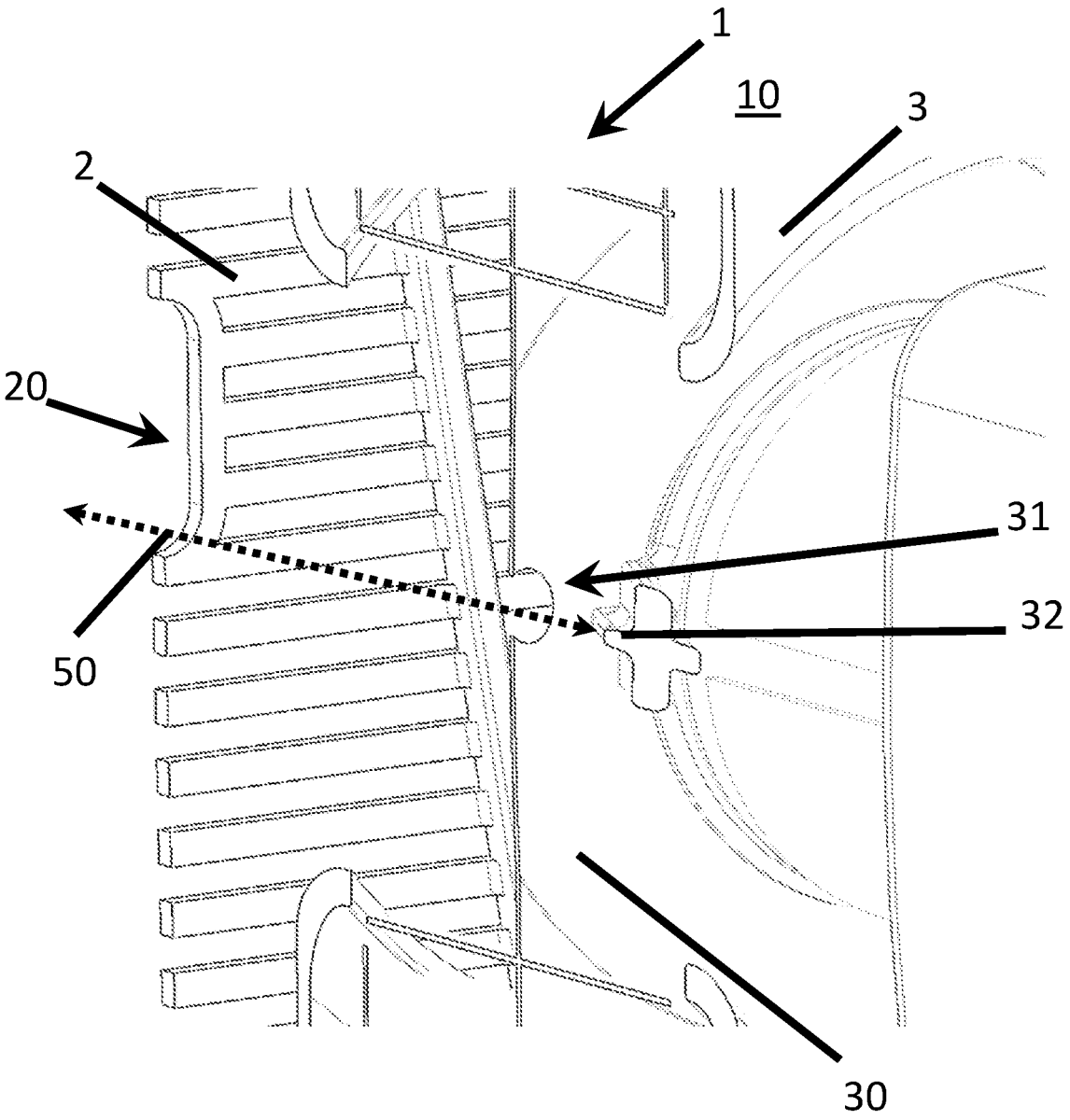
FIG. 2 shows a partial sectional view of the interior of the heating device of FIG. 1.

FIG. 2 shows the interior 10 of the heating device 1 of FIG. 1 in which the fan 3 is located behind the grid 2.

The fan 3 has a fan wheel 30 in which a passage point 31 is arranged. A reflection surface 32 which is here generated by a fastening rib is located therebehind. In case the fan wheel 30 is in a favorable position during rotation, a light signal can pass through the recess 20 in the grid 2 and through the passage point 31 in the fan wheel 30 to the reflection surface 32, and can be reflected back from there. The detection of the light signals is interrupted by a rotation of the fan wheel 30, from which the speed can be derived.

The recess 20 in the grid 2 has in particular the advantage of not disturbing the measurements even in the mounted state. For example, this allows the joint mounting of the fan 3 and the grid 2 as an already assembled manufacturing component.

Figure 3:
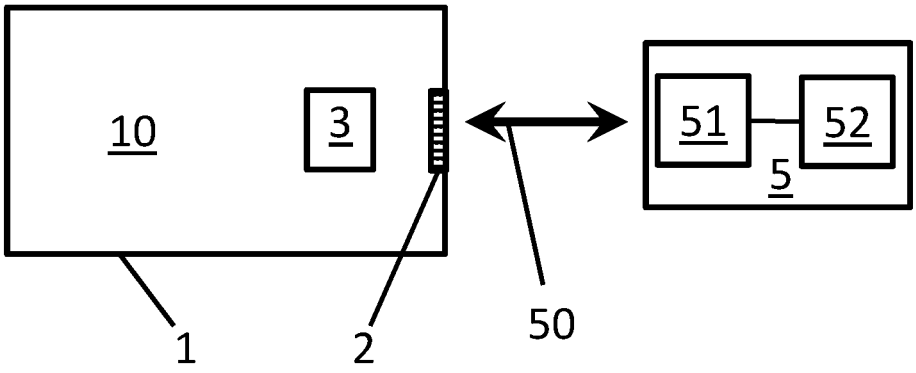
FIG. 3 shows a schematic representation of a measurement of the speed.

FIG. 3 shows a schematic view of a heating device 1 and a device for determining the speed of the fan 3 of the heating device 1.

The heating device 1 is fully assembled with the fan 3 in the interior 10 and the grid 2 in the wall of the heating device 1.

The measuring device 5 includes a light emitting and receiving device 51 and an evaluation device 52 for determining the speed of the fan 3 on the basis of the emitted and received light signals.

During measurement, the fan 3 is operated at a predetermined speed as a set value. Light signals 50 are emitted from the measuring device 5 and, for example after reflection at the surface of the fan wheel, are received as reflected signals. The effective speed is determined from the sequence of the received signals in connection with the data regarding the emitted signals, to generate a comparison result by a comparison with the set speed.

The invention claimed is:

1. A heating device, comprising:

a grid having a grid structure with elongated openings;

a fan located behind the grid in an interior of the heating device, the fan including a fan wheel and a plurality of blades protruding outward from the fan wheel;

a first opening in the fan wheel;

a second opening in the grid structure, the second opening having a different shape than the elongated openings of the grid structure; and a surface behind the first opening in the fan wheel, wherein the second opening in the grid structure and the first opening in the fan wheel overlap one another over a first rotational angle range of the fan that is less than 360 degrees and are nonoverlapping outside the first rotational angle range.

2. The heating device of claim 1, wherein the second opening in the grid structure is a circular opening.

3. The heating device of claim 1, wherein the surface behind the first opening in the fan wheel is a reflection surface configured to reflect a light signal that passes through both the second opening in the grid structure and the first opening in the fan wheel when the second opening and the first opening overlap one another over the first rotational angle range.

4. The heating device of claim 1, wherein the fan wheel is configured to reflect a light that passes through the second opening in the grid structure in each rotational position of the fan that is outside the first rotational angle range, and wherein the surface behind the first opening in the fan wheel is a scattering surface configured to scatter the light signal when the second opening in the grid structure and the first opening in the fan wheel are aligned with one another over the first rotational angle range.

5. The heating device of claim 1, wherein the surface behind the first opening in the fan wheel is a surface of a fastening rib.

6. A method of manufacturing a heating device, the method comprising:

mounting a fan in an interior of the heating device, the fan including a fan wheel, a plurality of blades protruding outward from the fan wheel, and a first opening in the fan wheel;

mounting a grid in front of the fan, the grid having a grid structure comprising elongated openings and a second opening in the grid structure, the second opening having a different shape than the elongated openings of the grid structure;

after the mounting of the fan and the mounting of the grid, emitting a light signal in a direction of the second opening in the grid structure; and determining a speed of the fan based on a reflected version of the light signal that exits the heating device through the second opening in the grid structure, wherein the second opening in the grid structure and the first opening in the fan wheel overlap one another over a first rotational angle range of the fan that is less than 360 degrees and are nonoverlapping outside the first rotational angle range.

7. The method of claim 6, wherein the second opening in the grid structure is a circular opening.

8. The method of claim 6, wherein a surface behind the first opening in the fan wheel reflects the light signal back toward the second opening in the grid structure over the first rotational angle range.

9. The method of claim 6, wherein the fan wheel reflects the light signal back toward the second opening in the grid structure in each rotational position of the fan that is outside the first rotational angle range, and wherein a surface behind the first opening in the fan wheel scatters the light signal over the first rotational angle range.

10. The method of claim 6, wherein a surface behind the first opening in the fan wheel is a surface of a fastening rib.

11. The method of claim 6, wherein the mounting of the fan and the mounting of the grid comprises jointly mounting the fan and the grid as a finished unit.

12. The method of claim 6, further comprising:

rotating the fan at a predetermined speed and/or setting a power level of the fan, wherein the predetermined speed and/or the power level represent a set fan speed value; and comparing the determined speed of the fan with the set fan speed value.

13. The method of claim 12, further comprising:

generating a comparison result based on a tolerance band for an admissible degree of deviation between the determined speed of the fan and the set fan speed value.

14. The method of claim 13, further comprising:

calibrating the heating device based on the comparison result.

15. The method of claim 13, further comprising:

adjusting the fan based on the comparison result.

16. The method of claim 13, further comprising:

replacing the fan based on the comparison result.

* * * * *